US005829729A

United States Patent [19]

Welch et al.

[11] Patent Number: 5,829,729

[45] Date of Patent: Nov. 3, 1998

[54] BOOK STAND

[76] Inventors: Stuart Macdonald Welch, Timecare Works, 60 Park Road West, Bedford, Great Britain, MK41 7SL; Ralph Selby, Providence Mill, Gorsey Bank, Wirksworth, Derbyshire, Great Britain, DE4 4AD

[21] Appl. No.: 728,243

[22] Filed: Oct. 8, 1996

[30] Foreign Application Priority Data

Oct. 10, 1995 [GB] United Kingdom ..... 9520692

[51] Int. Cl.[6] ..... A47B 19/00

[52] U.S. Cl. ..... 248/441.1; 248/459; 108/43

[58] Field of Search ..... 248/441.1, 445, 248/446, 450, 454, 455, 459, 460, 461, 444, 451, 452, 453; 108/43

[56] References Cited

U.S. PATENT DOCUMENTS

| | | | |
|---|---|---|---|
| 1,046,100 | 12/1912 | Miller | 248/452 |
| 2,587,316 | 2/1952 | Henry . | |
| 2,640,294 | 6/1953 | Walzak | 248/460 |
| 2,844,347 | 7/1958 | Henry | 248/460 |
| 3,034,253 | 5/1962 | Edwards | 248/459 |
| 3,176,953 | 4/1965 | Magers | 248/451 |
| 3,990,669 | 11/1976 | Smith | 248/459 |
| 4,460,146 | 7/1984 | Raggiotti | 248/460 |
| 4,749,161 | 6/1988 | Falcone | 248/459 |

FOREIGN PATENT DOCUMENTS 4206 of 1912 United Kingdom .

*Primary Examiner*—Leslie A. Braun
*Assistant Examiner*—Kimberly Wood
*Attorney, Agent, or Firm*—Leo Zucker

[57] ABSTRACT

A collapsible stand (1) for a book has, when erected for use, an upper member (7) that provides a support surface for a book, first and second side wall members (8) that are hingedly connected to the upper member (7), and front and rear wall members (10,11), that are hingedly connected to the side wall members (8). The upper member (7) and the front and rear wall members (10,11) are each foldable laterally about substantially the center line of the stand (1). The arrangement is such that folding the upper member (7) upwards from the erected position causes the first and second side wall members (8) to collapse towards one another and the front and rear wall members (10,11) to fold inwards.

10 Claims, 8 Drawing Sheets

BOOK STAND

BACKGROUND OF THE INVENTION

1. Field of the Invention

The present invention relates to a stand for a book or similar publication.

2. Discussion of the Known Art

Reference libraries sometimes contain books that, because of their age and fragility, require very careful handling to avoid damage. In such cases it is often a rule that although the books may be seen and used, they may not be handled except by the librarian. Therefore, if a reader wishes to use such a book, the librarian has to place the book in front of the reader and open it to the required page.

To prevent damage to the spine of the book, which might occur if the book was placed on a flat surface, the covers are often propped up with large wedge-shaped blocks of foam material. There are various disadvantages associated with this method of supporting the book, including that the blocks do not under all circumstances provide a very stable or secure support for the book, they take up a lot of space when not in use and there is a risk of the books being damaged by the chemicals contained within the foam material.

SUMMARY OF THE INVENTION

It is an object of the present invention to provide a book stand that mitigates at least some of the above-mentioned disadvantages.

According to the present invention there is provided a stand for a book, the stand being collapsible and comprising, when erected for use, an upper member that provides a support surface for a book, first and second side wall members each being hingedly connected to the upper member, and front and rear wall members, each being hingedly connected to each of the side wall members, the upper member and the front and rear wall members each being foldable laterally about substantially the centre line of the stand, the arrangement being such that folding the upper member upwards from the erected position causes the first and second side wall members to collapse towards one another and the front and rear wall members to fold inwards whereby, in the collapsed state, the folded front and rear walls are located between the first and second side wall members.

The stand provides a rigid and secure support surface, which allows the book to be placed at the correct angle for the reader without the risk of damaging the book. Further, because the stand is collapsible, very little storage space is required. This means that a large number of stands of different sizes can be stored, whereas before only a few foam blocks of perhaps only one or two sizes could be kept. The stands can also be made of materials that are not damaging to the books.

Further advantages associated with the stand are that it is light, easy to use and store and relatively inexpensive to manufacture.

Advantageously, the upper member comprises first and second substantially rigid panels, said first and second panels being hingedly joined to one another. The adjacent edges of said first and second panels are preferably shaped to provide, in the erected stand, a U-shaped channel, which accommodates the spine of the book.

The first and second panels are preferably arranged to provide, in the erected stand, a V-shaped support surface. This helps to prevent damage by ensuring that the book is not opened too far.

The upper member may be arranged to provide, in the erected stand, a forwardly-sloping support surface. This makes the book easier to read. The upper member may include a raised stop member such as a lip adjacent its forward edge to prevent the book sliding off the stand.

The front and rear wall members are advantageously arranged, in use, to engage and support the lower surface of the upper member. This produces a particularly stable and rigid structure.

Advantageously, the front and rear wall members are so arranged that, when the stand is collapsed, the front and rear wall members do not overlap one another. This allows the collapsed stand to have a thickness equal to only four times the thickness of the sheet material from which it is made. The rear wall member may include a cut-away portion to accommodate the front wall member.

The stand is preferably formed from a blank comprising a plurality a substantially rigid panels hingedly joined to one another. The stand may thus have a very simple structure and be relatively inexpensive to manufacture.

Advantageously, the blank comprises a sheet of resilient material and a plurality of substantially rigid panels secured thereto, the panels being hingedly joined to one another by the resilient material. This further simplifies the structure and allows the panels and the hinges to be formed, for example by thermo-forming, in a one-shot process.

The resilient material advantageously comprises a foamed plastics material, for example foamed polyethylene, and is preferably foamed with an inert gas such as nitrogen. The plates may be of aluminium or cardboard, for strength and lightness.

BRIEF DESCRIPTION OF THE DRAWING

By way of example, an embodiment of the invention will now be described with reference to the accompanying drawings, of which.

DETAILED DESCRIPTION OF THE INVENTION

Figure 8:
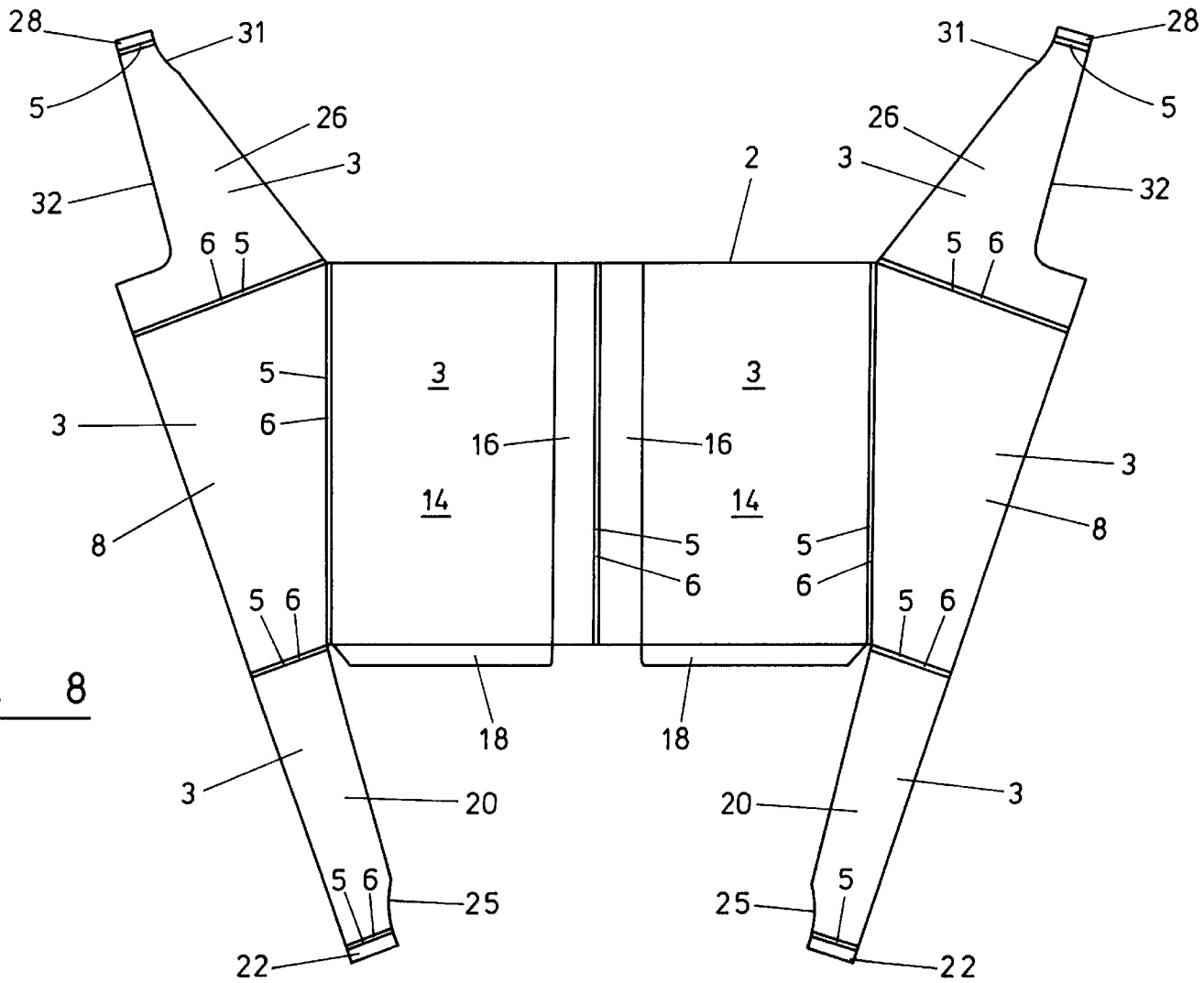
FIG. 8 is a view of a blank from which the stand is assembled.

The collapsible stand 1, which is shown in FIGS. 1 to 7 in erected, partly collapsed and collapsed states, is constructed from a blank 2 of sheet material, shown in FIG. 8. Various materials may be used for the blank 2, but in a particularly preferred embodiment, the blank is made of a composite material comprising an aluminium skeleton sandwiched between layers of polyethylene foam. Preferably, the foam is blown with an inert gas such as Nitrogen, to prevent damage to rare and valuable books placed on the stand.

The aluminium skeleton is made up of a set of rigid aluminium plates 3, each having a thickness of about 1 mm to 3 mm. The plates 3 are laid out in the arrangement shown in FIG. 8 and are encased (for example, in a hot press) between two layers of polyethylene foam. Gaps 5 of width about 5 mm are left between the plates 2 so that, in these regions, the polyethylene foam forms a continuous hinge 6 between the adjacent plates.

Figure 1:
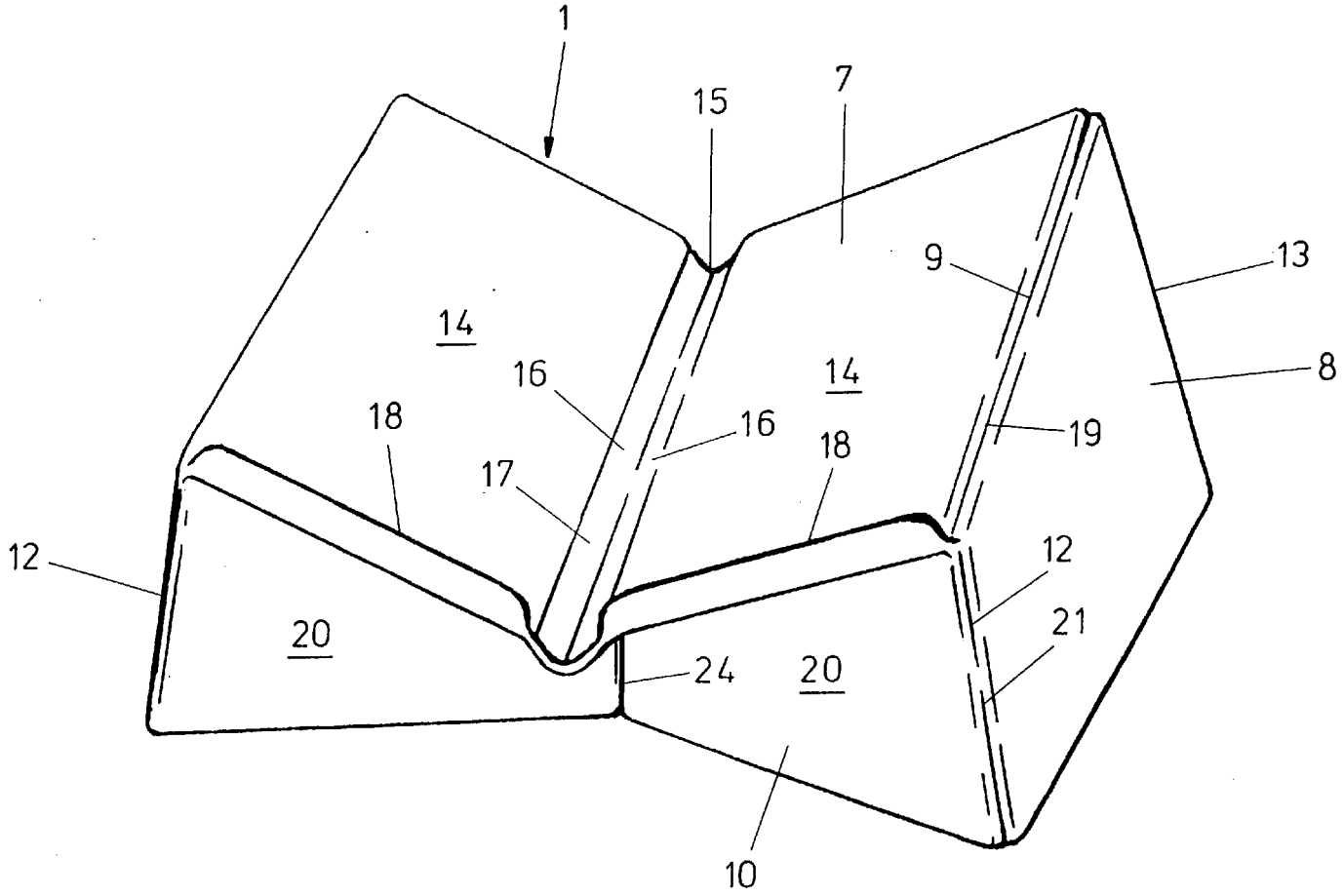
FIG. 1 is perspective view of the book stand from the front.
Figure 2:
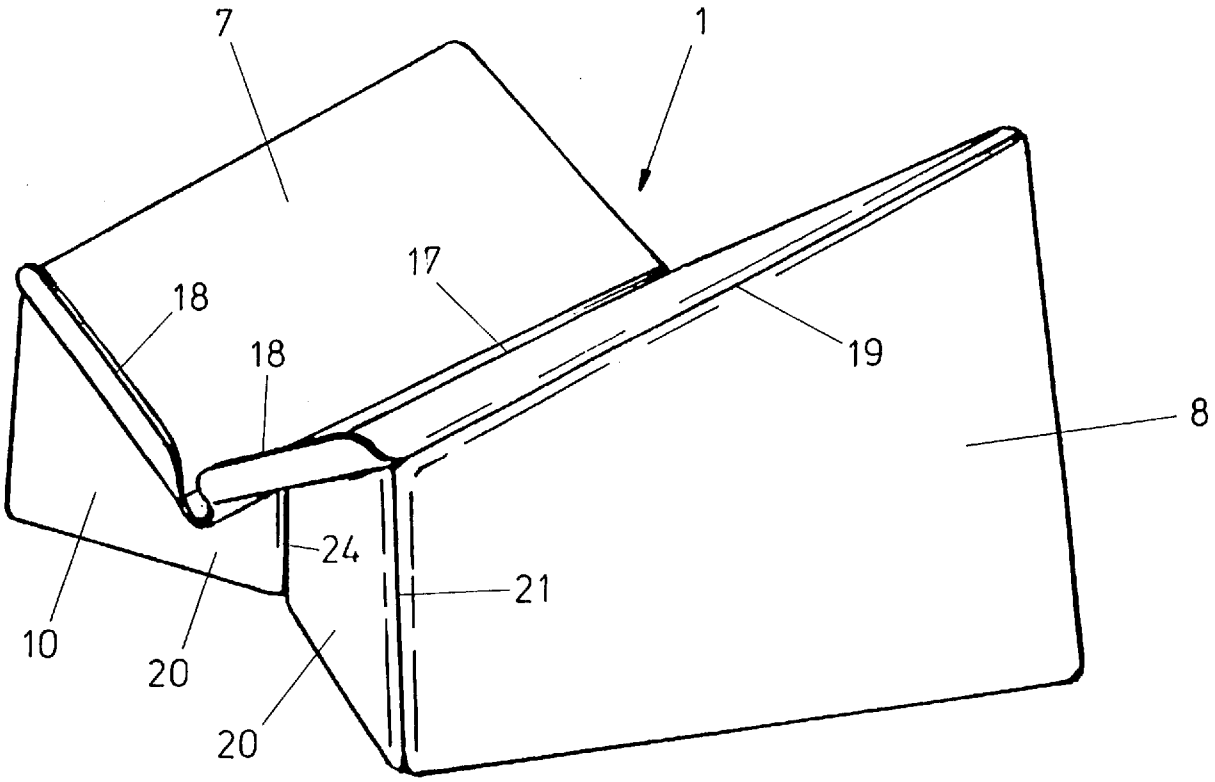
FIG. 2 is perspective view of the book stand from the front and to one side.
Figure 3:
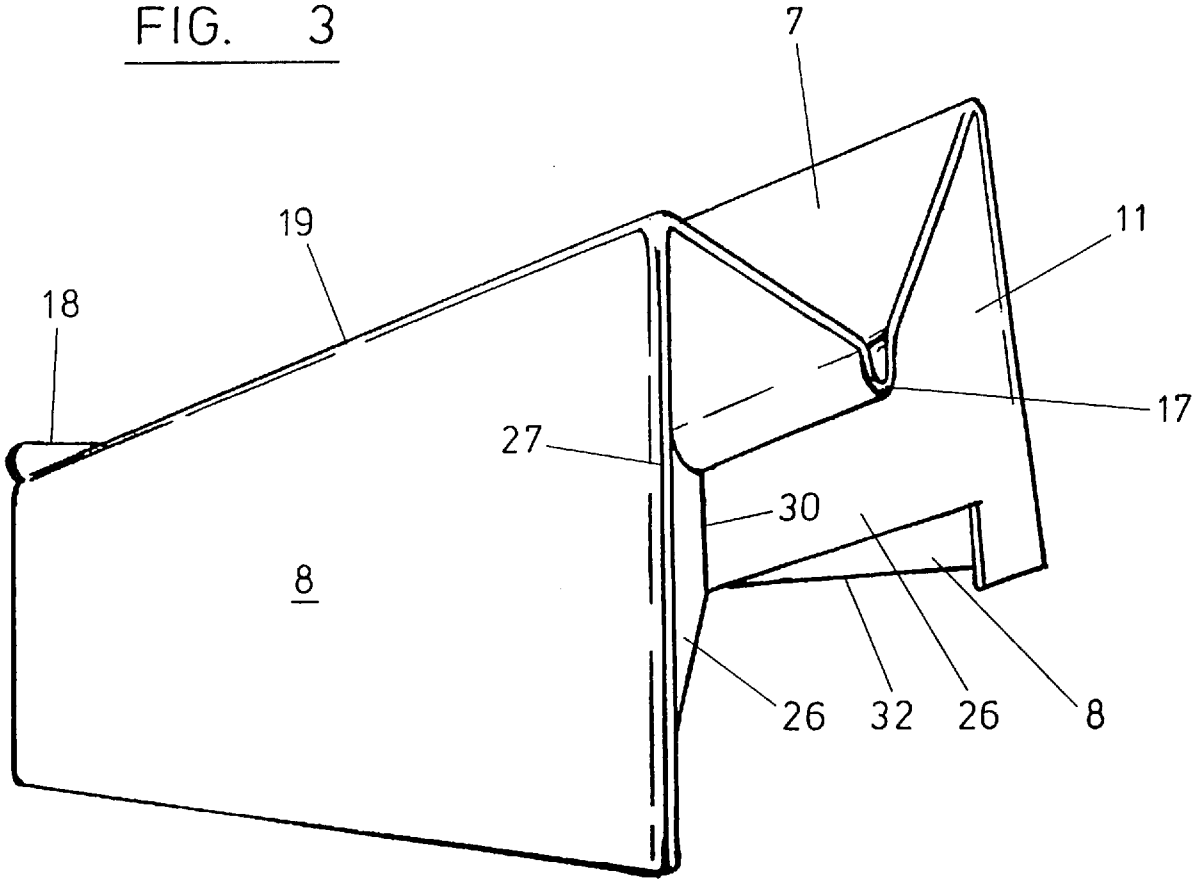
FIG. 3 is perspective view of the book stand from the rear and to one side.
Figure 4:
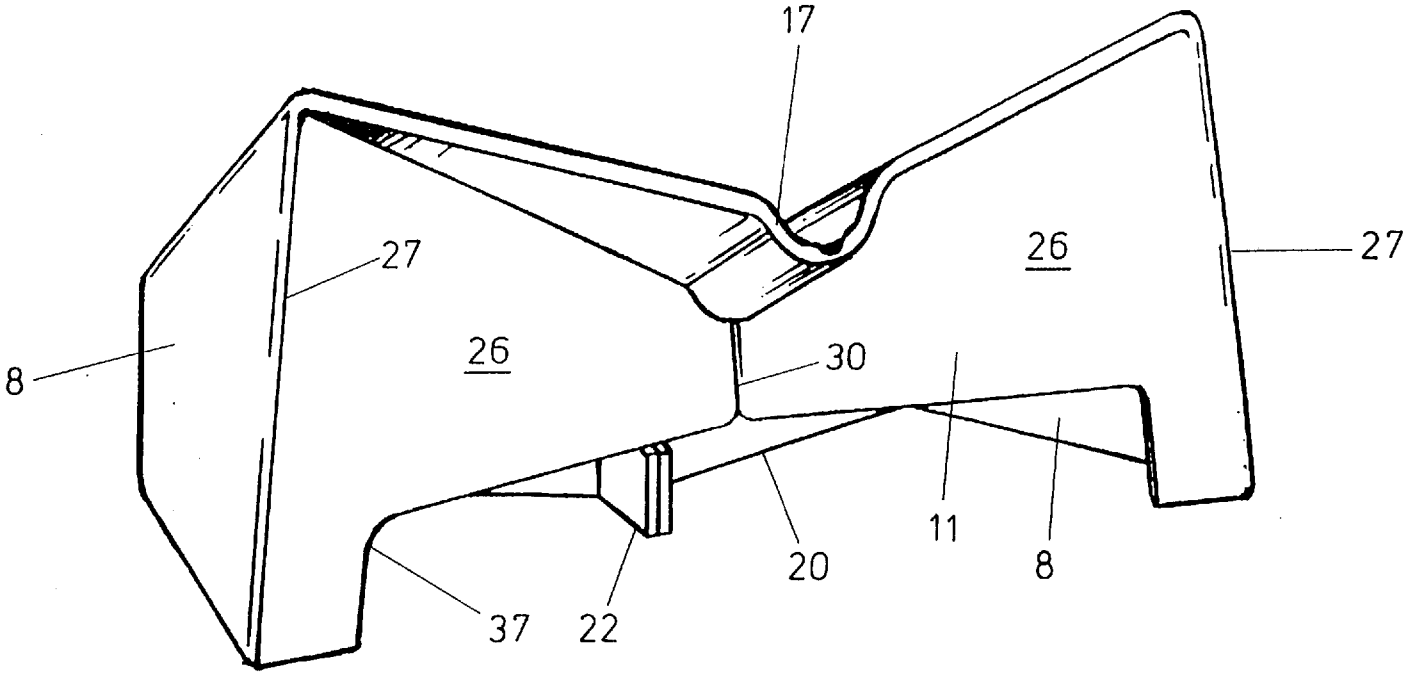
FIG. 4 is perspective view of the book stand from the rear.

The finished blank therefore comprises a series of substantially rigid panels that are joined to one another along hinge lines. Those panels form in the erected stand (as shown in FIG. 1) an upper member 7 that provides a support surface for a book, first and second side wall members 8 that are hingedly connected to the lateral edges 9 of the upper member, and front and rear wall members 10,11 that are hingedly connected to the substantially upright front and rear edges 12,13 respectively of the side wall members 8.

The upper member 7 comprises two substantially rectangular panels 14 that are foldable laterally relative to one another about a hinge 15 that lies on the centre line of the stand. The inner edge 16 of each of the panels 14 is bent downwards below the plane of the panel and then curved in the reverse direction so that in the erected stand, as shown in FIG. 1, the two edges 16 together form a U-shaped channel 17. In use, this channel 17 accommodates the spine of the book. The front edges 18 of the panels 14 are bent upwards, to prevent books sliding off the stand.

The two side wall members 8 are each trapezoidal, having a rear edge 13 that is longer than its front edge 12, so that the upper member 7 slopes forwards. The side wall members 8 are joined to the upper member 7 by hinges 19 along their upper edges.

The front wall member 10 comprises two substantially trapezoidal front panels 20, each of which is joined by a hinge 21 at the longer of its two unequal edges to the front edge 12 of a respective one of the side wall members 8. A small tab 22 is connected by a hinge to the shorter of the unequal edges of each front panel 20 and, in the assembled stand, these tabs 22 are bent inwards and joined to one another in a face-to-face relationship, so forming a hinge 24 that connects the two front panels 20 to one another. The hinge 24 lies substantially on the centre line of the stand. A cut-away portion 25 is formed at the upper front corner of each front panel 20, adjacent the tab 22, to accommodate the U-shaped channel 17 of the upper member 7.

The rear wall member 11 comprises two substantially trapezoidal rear panels 26, each of which is joined by a hinge 27 at the longer of its two unequal edges to the rear edge 13 of a respective one of the side wall members 8. A small tab 28 is connected by a hinge 29 to the shorter of the unequal edges of each rear panel 26 and, in the assembled stand, these tabs 28 are bent inwards and joined face-to-face to one another, so forming a hinge 30 that connects the two rear panels 26. The hinge 24 lies substantially on the centre line of the stand. A cut-away portion 31 is formed at the upper corner of each rear panel 26, adjacent the tab 28, to accommodate the U-shaped channel 17 of the upper member 7. A further cut-away portion 32 is formed in the lower edge of each rear panel 26, extending from the tab end of the panel 26 to a point a few centimetres from the hinge 27 with the side wall member 8. In use, this lower cut-out portion 32 allows the front and rear wall panels 20,26 to fold past one another without touching or overlapping as the stand is collapsed.

The sizes and shapes of the various panels are selected so that in the erected form, as shown in FIGS. 1 to 4, the upper edges of the front and rear wall panels 20,26 engage and support the lower surfaces of the upper panels 14. The panels 20,26 engage the upper member 7 inwardly of its front and rear edges, which helps to prevent sagging of the support surface. The side wall members 8 slope inwards to increase the stability of the stand and the lower edges of those members and the front and rear wall members 10,11 engage the flat surface on which the stand is placed for use.

The arrangement provides a very rigid and stable structure that is capable of safely supporting the weight of a large book. The trapezoidal shape of the front and rear wall panels 20,26 dictates that the upper member 7 adopts a shallow V-shape that, with the U-shaped channel 17, provides an ideal support surface for a book and allows the book to be propped open without causing damage to the spine. The design of the stand is such that the weight of the book tends to lock the stand in the erected position, so preventing it from collapsing. Finally, the soft covering of foam material prevents damage to the covers.

Figure 5:
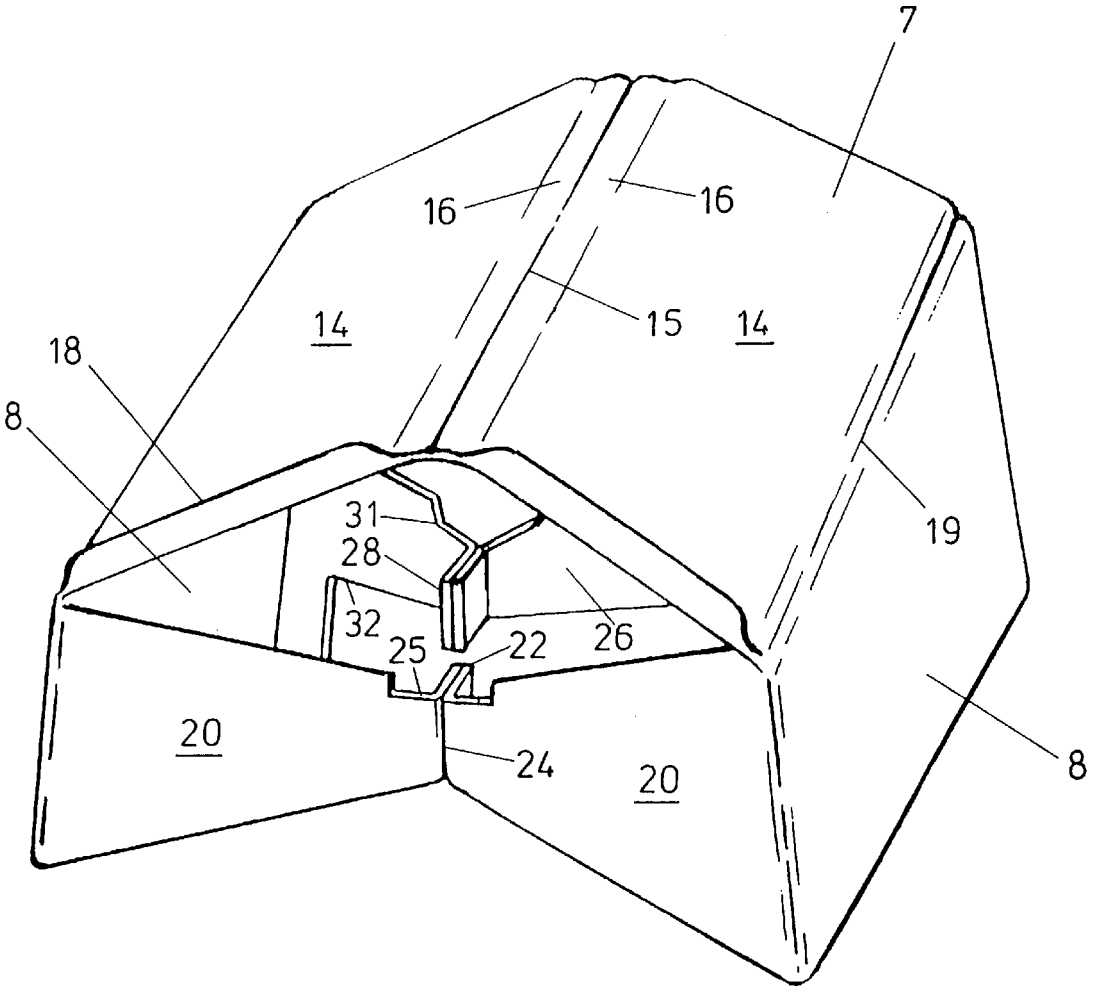
FIG. 5 is perspective view of the book stand from the front, showing the stand in a partly collapsed state.
Figure 6:
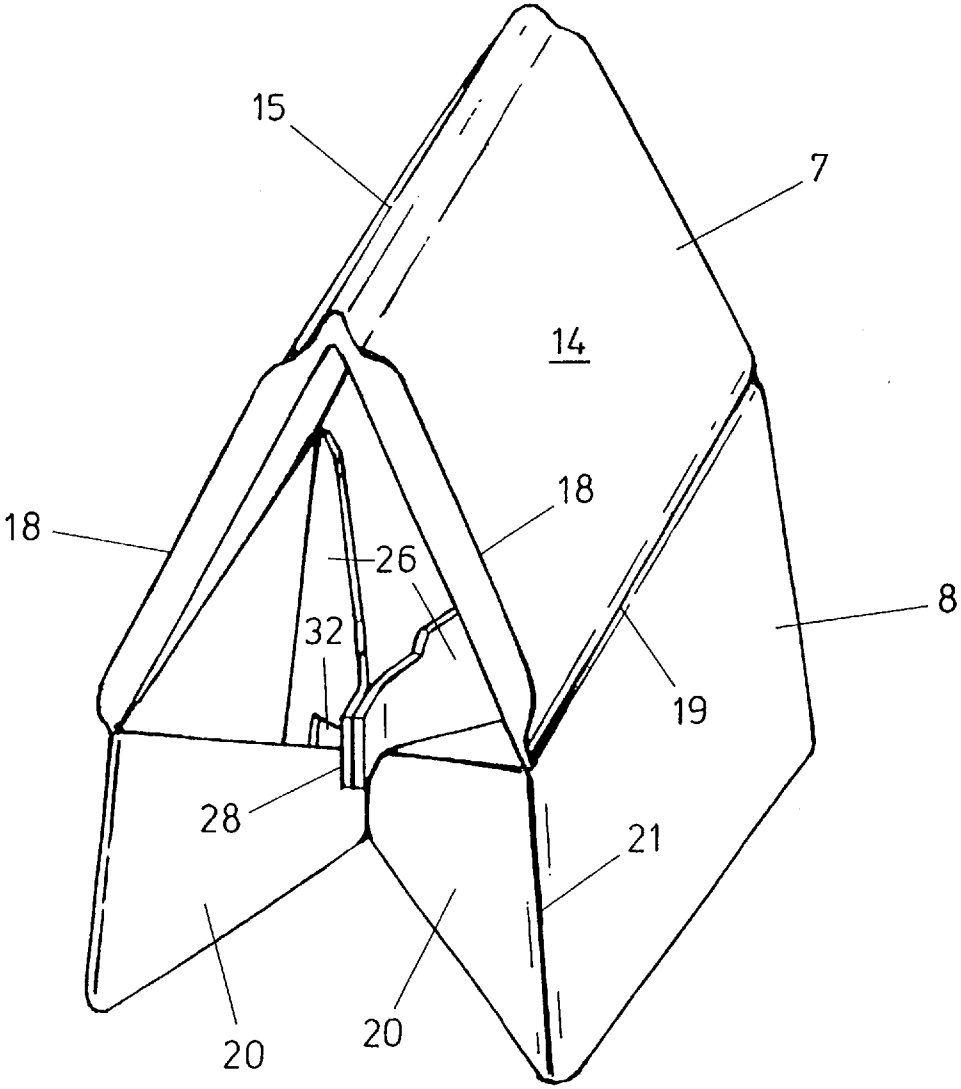
FIG. 6 is perspective view of the book stand, showing the stand further collapsed.
Figure 7:
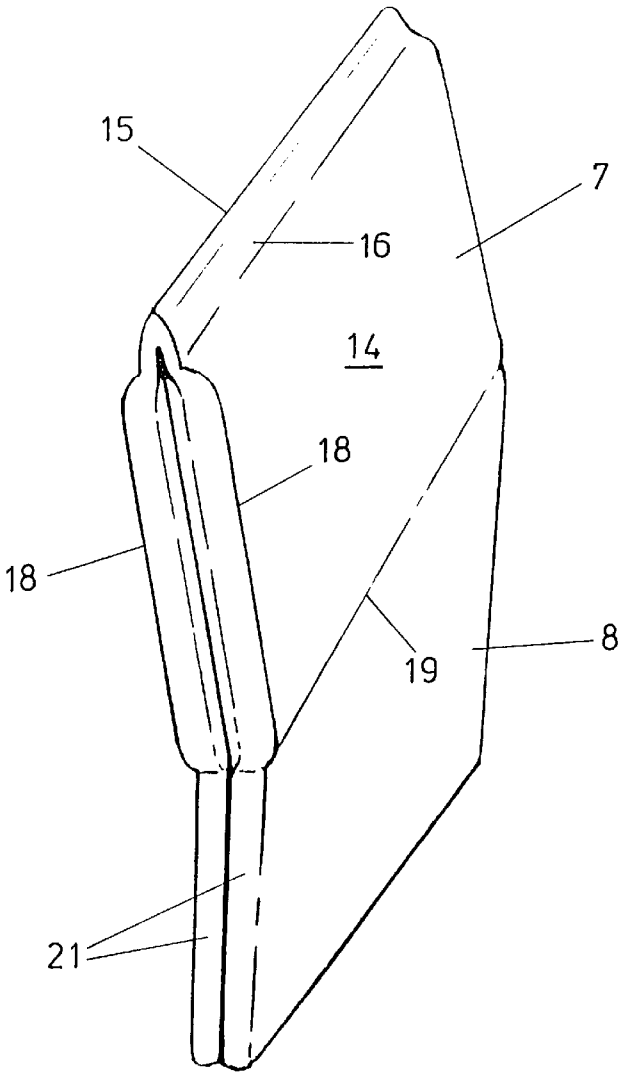
FIG. 7 is perspective view of the book stand in a completely collapsed state.

In order to fold the stand for storage, the upper member 7 is folded upwards by lifting it adjacent the inner edges 16 of the upper panels 14, as shown in FIGS. 5 and 6. This causes the two side wall members 8 to collapse towards one another and the front and rear wall members 10,11 to fold inwards. The cut-away portion 32 in the lower edge of each of the rear wall panels 26 is similar in shape to, and slightly larger than, the corresponding front wall panel 20, which allows the front and rear wall panels 20,26 to pass by one another as shown in FIG. 6 without touching or overlapping. Thus, in the completely collapsed state, shown in FIG. 7, the folded front and rear walls panels 20,26 are located between the side wall members 8 and the collapsed stand 1 has a thickness equal to only four times the thickness of the blank 2.

Various modifications of the stand are, of course, possible. For example, the stand may be made in different shapes and sizes without departing from the principles described herein, so as to accommodate books and other publications of various different sizes and weights. Different materials and constructions may also be chosen for the stand. For example, for small and medium stands, the foam material may have sufficient rigidity to make the aluminium skeleton unnecessary. Larger stands may be made by, for example, high frequency welding of PVC or polypropylene over a skeleton of aluminium or cardboard. It is also possible to manufacture the covering in fabric, which is sewn to provide pockets for the aluminium or cardboard skeleton. If necessary, the panels and hinges may be formed separately, rather than as a single unit.

Further possible modifications include the provision of soft foam panels on the upper surface of the upper member 7 to accommodate, for example, books with heavily embossed covers. Alternatively, malleable cushions, for example bean bags, may be provided on the upper surface of the upper member 7 to accommodate books with very tight bindings.

The stand may also be useful for other applications, for example for supporting very large publications such as newspapers, which are otherwise difficult to handle. In such cases, the upper member 7 may if necessary be extended outwards beyond the supporting walls 8,10,11 to provide a larger support surface.

We claim:

1. A stand for a book, the stand being collapsible and comprising;

an upper member that provides a V-shaped support surface for a book, said upper member having a front edge, a rear edge and two side edges and being foldable about a first fold line that extends from said front edge to said rear edge;

first and second side wall members, each having an upper edge, a lower edge, a front edge and a rear edge, said first and second side wall members each being hingedly connected at its upper edge to a corresponding side edge of the upper member; and front and rear wall members, each having an upper edge, a lower edge and two side edges and being foldable about a second fold line that extends from said upper edge to said lower edge, said front and rear wall members each being hingedly connected at its two side edges to corresponding ones of the front edges and the rear edges of the side wall members, the upper edge of each of the front and the rear wall members being free edges so that, when the front and the rear wall members unfold on the second fold line beneath the upper member to place the stand in an erected state, the upper edges engage and support the upper member when an opened book is placed on the support surface, and the arrangement being such that lifting the upper member upwards to fold along the first fold line from the erected position causes the first and the second side wall members to collapse towards one another and the front and the rear wall members to fold inwards alone the second fold line whereby, when the stand is in the collapsed state, the folded front and rear wall members are located between the first and the second side wall members.

2. A stand according to claim 1, in which the upper member comprises first and second substantially rigid panels, said first and second panels being hingedly joined to one another.

3. A stand according to claim 2, in which adjacent edges of said first and second upper member panels are shaped to provide, in the erected stand, a U-shaped channel.

4. A stand according to claim 1, in which the upper member is arranged to provide, in the erected stand, a forwardly-sloping support surface.

5. A stand according to claim 4 in which the upper member includes a raised stop member adjacent its front edge.

6. A stand according to claim 1, wherein the front and rear wall members are so arranged that, when the stand is in a collapsed state, the front and rear wall members do not overlap one another.

7. A stand according to claim 6, in which the rear wall member includes a cut-away portion to accommodate the front wall member.

8. A stand according to claim 1, the stand being formed from a blank comprising a plurality of substantially rigid plates hingedly joined to one another.

9. A stand according to claim 8, wherein the blank comprises a sheet of resilient material and a plurality of substantially rigid plates secured thereto, the plates being hingedly joined to one another by the resilient material.

10. A stand according to claim 9, in which resilient material comprises a foamed plastics material.

* * * * *